US007032666B2

(12) United States Patent
Corbett

(10) Patent No.: US 7,032,666 B2
(45) Date of Patent: Apr. 25, 2006

(54) GRAVEL PACK CROSSOVER TOOL WITH CHECK VALVE IN THE EVACUATION PORT

(75) Inventor: Thomas G. Corbett, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 250 days.

(21) Appl. No.: 10/631,263

(22) Filed: Jul. 31, 2003

(65) Prior Publication Data

US 2004/0069489 A1 Apr. 15, 2004

Related U.S. Application Data

(60) Provisional application No. 60/400,351, filed on Aug. 1, 2002.

(51) Int. Cl.
*E21B 43/04* (2006.01)
*E21B 34/10* (2006.01)

(52) U.S. Cl. ..... 166/278; 166/51; 166/329; 166/386

(58) Field of Classification Search ..... 166/278, 166/51, 305.1, 381, 386, 387, 316, 318, 325, 166/329, 332.8
See application file for complete search history.

(56) References Cited

U.S. PATENT DOCUMENTS

| | | | | | |
|---|---|---|---|---|---|
| 3,441,084 | A | | 4/1969 | Fredd | |
| 3,554,281 | A | | 1/1971 | Ecuer | |
| 3,850,246 | A | | 11/1974 | Despujols | |
| 3,913,676 | A | * | 10/1975 | Barbee et al. | 166/278 |
| 3,963,076 | A | * | 6/1976 | Winslow | 166/278 |
| 3,987,854 | A | * | 10/1976 | Callihan et al. | 166/278 |
| 4,420,041 | A | | 12/1983 | Patel | |
| 4,541,484 | A | | 9/1985 | Salerni et al. | |
| 4,633,943 | A | * | 1/1987 | Zunkel | 166/51 |
| 4,633,944 | A | * | 1/1987 | Zunkel et al. | 166/51 |
| 4,635,716 | A | * | 1/1987 | Zunkel | 166/51 |
| 4,858,690 | A | * | 8/1989 | Rebardi et al. | 166/278 |
| 5,443,117 | A | | 8/1995 | Ross | |
| 5,597,040 | A | * | 1/1997 | Stout et al. | 166/51 |
| 5,620,050 | A | * | 4/1997 | Barbee | 166/278 |
| 5,865,251 | A | | 2/1999 | Rebardi et al. | |
| 6,065,535 | A | | 5/2000 | Ross | |
| 6,702,020 | B1 | * | 3/2004 | Zachman et al. | 166/278 |
| 2002/0096328 | A1 | * | 7/2002 | Echols et al. | 166/278 |
| 2003/0188866 | A1 | * | 10/2003 | Bissonnette et al. | 166/278 |
| 2005/0103495 | A1 | * | 5/2005 | Corbett | 166/278 |

FOREIGN PATENT DOCUMENTS

EP 1132571 A1 9/2001

OTHER PUBLICATIONS

OSCA, "Multi-Position Set-Down Service Tool," Technical Bulletin, 1 page, 2000.

* cited by examiner

*Primary Examiner*—Jennifer H. Gay
(74) *Attorney, Agent, or Firm*—Steve Rosenblatt

(57) ABSTRACT

A gravel packing method and apparatus so that when setting the packer, a ball is dropped to a seat that is isolated from the effects of formation pressures when trying to set the packer. This is accomplished by isolation of the gravel pack outlet port when setting the packer and locating the ball seat in a position where the effects of formation pressure are irrelevant. Additionally, by positioning the evacuation ports above a seal bore in the screen extension during circulation to deposit gravel and further putting check valves in the evacuation ports, the evacuation step after circulation can be accomplished without having to reposition the crossover.

20 Claims, 2 Drawing Sheets

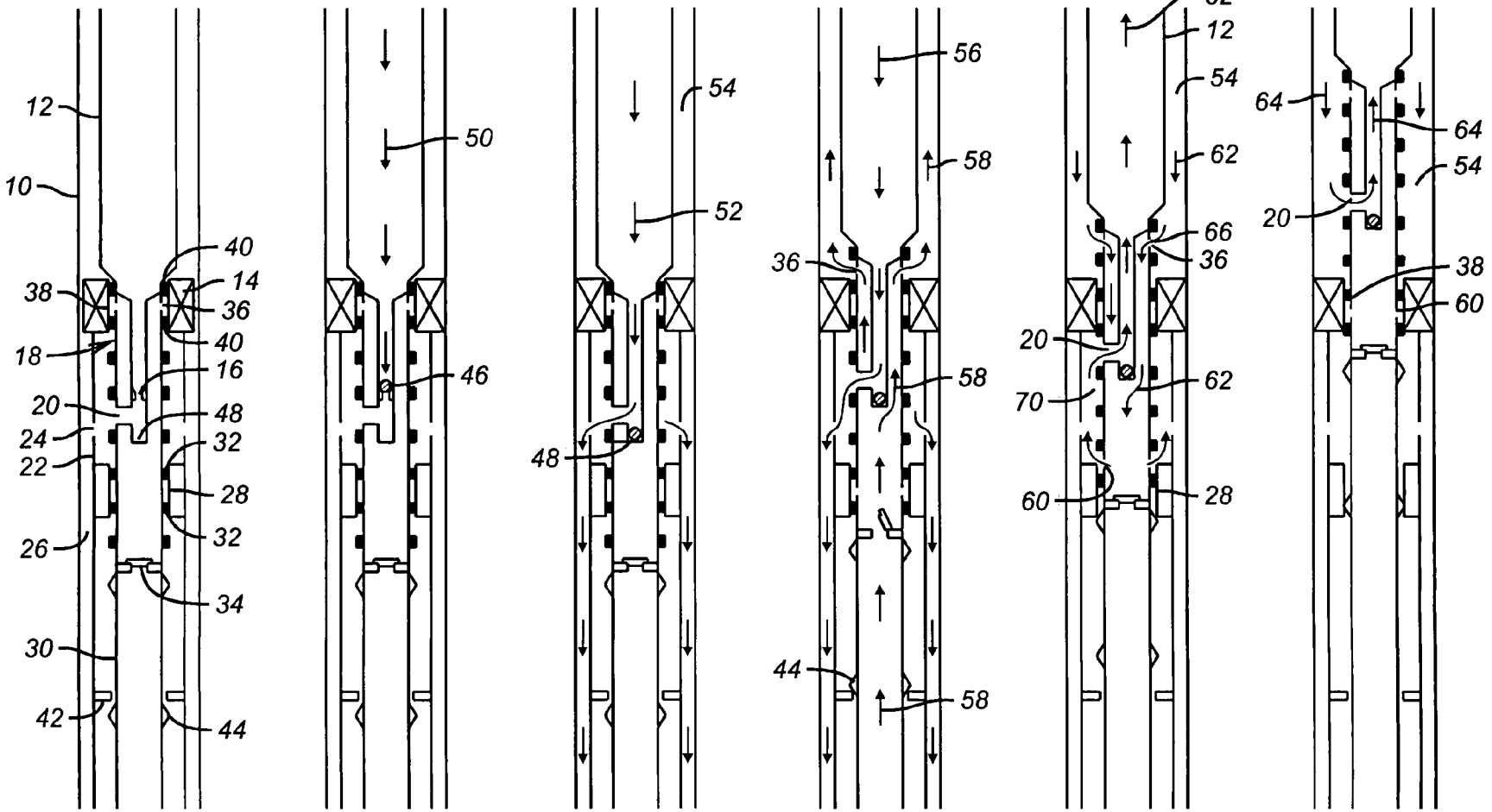
(PRIOR ART) FIG. 1
(PRIOR ART) FIG. 2
(PRIOR ART) FIG. 3
(PRIOR ART) FIG. 4
(PRIOR ART) FIG. 5
(PRIOR ART) FIG. 6

2/2

GRAVEL PACK CROSSOVER TOOL WITH CHECK VALVE IN THE EVACUATION PORT

PRIORITY INFORMATION

This application claims the benefit of U.S. Provisional Application No. 60/400,351 on Aug. 1, 2002.

FIELD OF THE INVENTION

The field of this invention is crossover tools for gravel packing a screen downhole and more particularly to crossover tools that don't require raising the tool to evacuate position before the tubing string is reversed out.

BACKGROUND OF THE INVENTION

FIGS. 1–6 illustrate the prior art crossover tool in a typical gravel packing operation. The wellbore 10 receives a running string and setting tool shown schematically as 12. A packer 14 sealingly accepts the string and setting tool 12. A ball seat 16 is located in the crossover tool 18 just above gravel pack port 20. Screen extension 22 is attached to packer 14 and has ports 24 to permit gravel access to annulus 26. Screen extension 22 has a seal bore 28 through which a wash pipe 30 extends in sealing contact for run in, shown in FIG. 1, due to contact of seals 32. A flapper 34 allows uphole flow in wash pipe 30 and prevents downhole flow. Return ports 36 are in the seal bore 38 of the packer 14 and are closed due to the position of seals 40 that straddle return ports 36 in seal bore 38. Screen extension 22 has a support surface 42 that can engage tabs 44 to pinpoint the circulation position of FIG. 4.

To set the packer 14, the assembly is run into position, as shown in FIG. 1 and a ball 46 is dropped onto ball seat 16. Ultimately, after the packer is set, the ball 46 is blown through ball seat 16 or the ball and the seat move together after a shear pin (not shown) is broken and the assembly lands in recess 48 (see FIG. 3). One of the problems with this layout is that if the formation is under sub-hydrostatic pressure, such sub-hydrostatic pressure communicates with the underside of ball 46 on seat 16 and limits the amount of pressure that can be applied from above, shown schematically as arrows 50, before breaking a shear pin on the ball seat 16. This can reduce the available pressure to set the packer 14 because the sub-hydrostatic pressure on the underside of ball 46 acts equivalently to applied pressure from above, represented by arrows 50. Yet another drawback of this arrangement is that when the packer 14 makes contact with the wellbore 10 and the passage through its seal bore 38 is obstructed, the liquid column above the packer 14 can no longer exert pressure on the formation. This can result in portions of the formation breaking off into the wellbore and potentially obstructing it. The present invention addresses these problems by repositioning the ball seat 16' and insuring that the seal bore 38' is not closed by the crossover tool 18' during setting of the packer.

Continuing now with the prior technique, after the packer 14 is set, the ball 46 and the seat 16 are blown into recess 48. The set of the packer can be tested by applying pressure to annulus 54. Furthermore, gravel slurry or fluid represented by arrows 52 can be squeezed into the formation adjacent to the screens (not shown) as illustrated in FIG. 3. The fluid represented by arrow 52 flows through the crossover tool 18 to exit the gravel pack port 20 and then flows through ports 24 in screen extension 22 into the annulus 26 around the outside of the screens (not shown). Returns are blocked off because the return ports 36 are sealingly positioned in seal bore 38 of the packer 14 by virtue of straddle seals 40. Any leakage past packer 14 will be seen as a pressure rise in annulus 54.

The next step is circulation, shown in FIG. 4. Here the gravel slurry represented by arrows 56 passes through the crossover 18 through gravel pack ports 20. It then passes through ports 24 in screen extension 22 and into the annulus 26. The gravel remains behind in annulus 26 around the screens (not shown) and the carrier fluid, represented by arrows 58, passes through the screens and opens flapper 34. It should be noted that the crossover 18 has been raised slightly for this operation to expose return ports 36 into annulus 54 above packer 14. The carrier fluid 58 passes the flapper 34 and exits the return ports 36 and goes to the surface through annulus 54. Lug 44 rests on support surface 42 to allow the crew at the surface to know that the proper position for circulation has been reached.

In the next step, called evacuation, the excess gravel that is in the annulus 70 between the screen extension 22 and the crossover tool 18 needs to be reversed out so that the crossover tool 18 will not stick in the packer seal bore 38 when the crossover tool 18 is lifted out. To do this, the crossover tool 18 has to be lifted just enough to get the evacuation ports 60 out of seal bore 28. Evacuation flow, represented by arrows 62 enters return ports 36 and is stopped by closed flapper 34. The only exit is evacuation ports 60 and back into gravel pack port 20 and back to the surface through the sting and setting tool 12. The problem here is that the intermediate position for reversing gravel out from below the packer 14 is difficult to find from the surface. Due to the string 12 being long and loaded with gravel at this point, the string is subject to stretch. The surface personnel for that reason are prone to wittingly or unwittingly skip this step and pull the crossover tool 18 up too high into the alternate reverse position shown in FIG. 6. In the FIG. 6 position, the evacuation ports 60 are closed in seal bore 38 of packer 14 and gravel pack port 20 is now above packer 14 in annulus 54. Arrows 64 show how the reversing flow clears out the string 12 above packer 14.

The problem with skipping the evacuation step is that the excess gravel in the annulus 70 below packer 14 may cause the crossover tool 18 to stick in seal bore 38 as the crossover tool 18 is raised to accomplish the reverse step shown in FIG. 6 or later when crossover tool 18 removal is attempted. The present invention allows the evacuation step to occur without having to reposition the crossover tool 18 with respect to the packer 14. This is accomplished by the addition of check valves 66 in relocated evacuation ports 60'. The present invention will be more readily appreciated by those skilled in the art from a review of the description of the preferred embodiment and the claims that appear below.

SUMMARY OF THE INVENTION

A gravel packing method and apparatus are described where to set the packer; a ball is dropped to a seat that it isolated from the effects of formation pressures when trying to set the packer. This is accomplished by isolation of the gravel pack outlet port when setting the packer and locating the ball seat in a position where the effects of formation pressure are irrelevant. Additionally, by positioning the evacuation ports above a seal bore in the screen extension during circulation to deposit gravel and further putting check valves in the evacuation ports, the evacuation step after circulation can be accomplished without having to reposition the crossover.

BRIEF DESCRIPTION OF THE DRAWINGS

FIG. 1 is the run in position of the prior art method of gravel packing;

FIG. 2 is the view of FIG. 1 in the packer setting position;

FIG. 3 is the view of FIG. 2 in the packer test and squeeze position

FIG. 4 is the view of FIG. 3 in the circulate to deposit gravel position;

FIG. 5 is the view of FIG. 4 in the evacuation position;

FIG. 6 is the view of FIG. 5 in the alternate reverse position;

DETAILED DESCRIPTION OF THE PREFERRED EMBODIMENT

Figures 7, 8, 9, 10, 11, 12:
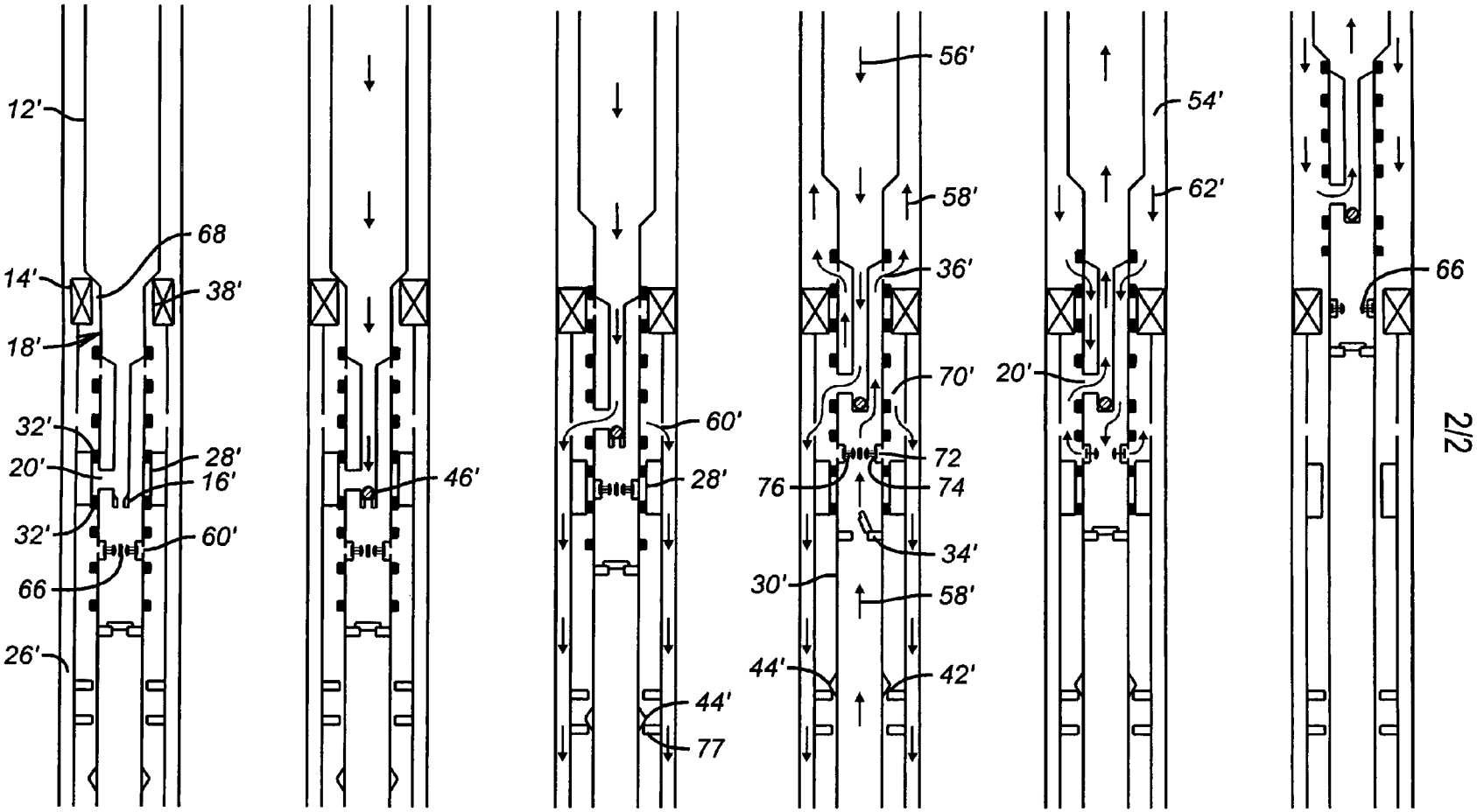
FIG. 7 is the present invention in the run in position.
FIG. 8 is the view of FIG. 7 in the packer set position.
FIG. 9 is the view of FIG. 8 in the test packer and squeeze position.
FIG. 10 is the view of FIG. 9 in the circulate to deposit gravel position.
FIG. 11 is the view of FIG. 10 in the evacuation position.
FIG. 12 is the view of FIG. 11 in the alternate reverse position.

In the run in position of FIG. 7, the seal bore 38' has a clearance 68 around the string and setting tool 12'. The ball seat 16' is located below gravel pack port 20'. During run in and setting of the packer 14', the gravel pack port 20' is sealed in seal bore 28' by virtue of seals 32'. When the ball 46' lands on seat 16' it will not go any lower. Thus exposure to sub-hydrostatic formation pressures below ball 46' will not affect the setting of packer 14'. This is because there is no longer any need to shear out the seat 16' due to its location below gravel pack port 20'. An upward shift of the crossover tool 18' will position gravel pack port 20' out and above seal bore 28', as illustrated in FIG. 10, so that gravel slurry 56' can be pumped down string 12' and into annulus 26' with returns 58' coming through flapper 34' and into annulus 54' by way of return ports 36'. It should be noted that during circulation, the evacuation ports 60' are above the seal bore 28' but internal pressure in wash pipe 30' is prevented from exiting the wash pipe 30' through the evacuation ports 60' by the presence of check valves 66. This is because the pressure in annular space 70' exceeds the pressure within the wash pipe 30' forcing the valve member 72 against its seat 74 with the assistance of spring 76.

The evacuation step shown in FIG. 11 can be accomplished without having to raise the crossover tool 18'. Instead the reverse flow indicated by arrows 62' goes down annulus 54', through return ports 36', and out through check valves 66. This time the pressure inside wash pipe 30' is greater than the pressure in annular space 70 and the valve members 72 are pushed against the bias of springs 76 to move away from their respective seats 74. The flow continues to gravel pack ports 20' and up to the surface through the string 12'. The fact that the position of the crossover tool 18' does not need to be changed after the circulation of the gravel into position, insures that the evacuation step will actually be executed. Insuring that the evacuation step is accomplished minimizes if not eliminates the risk of sticking the crossover tool 18' in the seal bore 38' of packer 14' due to remaining gravel in the annulus 70' below the packer 14' as the crossover tool 18' is being lifted for the reverse step of FIG. 12 or during its total removal at the conclusion of the gravel packing operation.

Those skilled in the art will readily appreciate the advantages of the present invention. First, since the ball seat 16' is never sheared out after setting the packer 14' because the ball seat 16' is already below the gravel pack outlet 20', the effects of sub-hydrostatic formation pressure on the packer setting operation go away. This is because there is no shear pin to break prematurely before the packer 14' is set due to sub-hydrostatic pressure on the underside of a seated ball 46', as can be seen in FIGS. 8–12.

The packer bore 38' has a clearance around the string and setting tool 12' when the packer is set. Thus, the liquid column to the surface is always acting on the formation even as the packer makes contact with the wellbore 10'. Having this column of fluid to exert pressure on the formation prevents cave in of the wellbore as the pressure prevents pieces of the formation from breaking off into the wellbore.

The crossover tool 18' does not need to be moved between circulation shown in FIG. 10 and evacuation, shown in FIG. 11. This insures proper removal of gravel from annulus 70' before trying to move the wash pipe 30'. The chance of sticking the crossover tool 18' in the seal bore 38' is reduced if not eliminated.

In the packer setting position of FIG. 8, the gravel pack ports 20' are sealed in seal bore 28'. To test the set packer, the crossover tool 18' is lifted slightly to expose the gravel pack port 20' and to put the evacuation ports 60' into seal bore 28' and the return ports 36' in seal bore 38' of the packer 14' as illustrated in FIG. 9. This position is found when tabs 44' land on support surface 77. To get into the circulation position of FIG. 10, the crossover tool 18' is picked up until tabs 44' land on support surface 42'. Both these positions are easy to determine from the surface because of tabs 44'. Then, without movement of the crossover tool 18' the flow direction is reversed, as shown in FIG. 11. The check valves 66 below the packer 14' are forced open and the gravel outside wash pipe 30' is pushed out through the gravel pack port 20' and to the surface through string 12'.

The foregoing disclosure and description of the invention are illustrative and explanatory thereof, and various changes in the size, shape and materials, as well as, in the details of the illustrated construction, may be made without departing from the invention.

I claim:

1. A gravel packing method, comprising:

running in a packer and a screen assembly supported by said packer;

inserting an assembly of a crossover that supports a wash pipe at least in part into said packer;

flowing gravel through the packer and the crossover and through an annular space between the screen assembly and the wash pipe to an annular region outside the screen assembly;

removing excess gravel in said annular space;

not moving the crossover and wash pipe at any time after said flowing to during said removing.

2. The method of claim 1, comprising:

providing a seat on said crossover to accept an obstructing object for setting the packer, positioning the seat so that pressure can be built up on the obstructing object to a predetermined level without any effect from downhole pressure acting below the object on the seat.

3. The method of claim 1, comprising:
providing a clearance in the bore of the packer as it is set;
allowing a fluid column to act through said clearance during setting of the packer to exert pressure on the formation below the packer for resisting cave-ins into the wellbore.

4. The method of claim 1, comprising:
flowing fluid through said packer in a first direction to deposit said gravel in said annular region and reversing the direction of flow through said packer to a second direction to remove excess gravel from said annular space.

5. The method of claim 1, comprising:
providing at least one return port in said wash pipe;
exposing said return port to said annular space;
providing a first check valve in said return port.

6. The method of claim 5, comprising:
preventing returning fluid, flowing in a first direction, that passes through the screen assembly after leaving gravel in said annular region and entering said wash pipe, from flowing through said return port because of said first check valve.

7. The method of claim 6, comprising:
providing a second check valve in a flow path through said wash pipe;
allowing fluid, that enters a lower end of said wash pipe, in said first direction, to pass said second check valve while preventing fluid entering said wash pipe from said crossover, in a second direction, from passing said second check valve.

8. The method of claim 7, comprising:
flowing fluid in said second direction into said wash pipe;
preventing said fluid from passing out of the lower end of said wash pipe with said second check valve;
allowing fluid from within said wash pipe to pass said first check valve through said return port and through said annular space before retuning through said packer carrying off at least some of the remaining gravel in said annular space.

9. The method of claim 8, comprising:
providing a seal bore in said screen assembly;
extending said wash pipe through said seal bore;
defining said annular space between said seal bore and said packer; and
selectively positioning said return ports within or above said seal bore.

10. The method of claim 9, comprising:
blocking a passage in said packer for fluid return to the surface when said return port is in said seal bore;
forcing fluid to enter the formation after depositing gravel in said annular region, when flowing in said first direction.

11. The method of claim 9, comprising:
opening a passage in said packer for fluid return to the surface when said return port is out said seal bore and disposed in said annular space;
allowing fluid flowing in said first direction to pass through said screen, enter said wash pipe past said second check valve and flow through said opened passage in said packer to the surface.

12. The method of claim 11, comprising:
reversing to said second fluid direction with said passage open in said packer and said return port in said annular space for said removal of gravel from said annular space.

13. The method of claim 11, comprising:
providing tabs on said wash pipe to engage said screen assembly for support in a first position with said return port in said seal bore and a second position with said return port above said seal bore.

14. The method of claim 2, comprising:
providing a gravel outlet from said crossover that can selectively be positioned in fluid communication with said annular space; and
locating a seat in said crossover below said gravel outlet.

15. The method of claim 14, comprising:
fixedly mounting said seat;
dropping an object onto said seat;
setting said packer with pressure built up on said seat.

16. The method of claim 15, comprising:
providing a seal bore in said screen assembly;
positioning said gravel outlet in said seal bore for said setting said packer;
moving said gravel outlet into fluid communication with said annular space to permit flow in a first direction for depositing gravel in said annular region.

17. The method of claim 16, comprising:
allowing said object to remain on said seat after setting said packer to block flow in said first direction from entering said wash pipe while directing such flow out of said crossover through said gravel outlet.

18. The method of claim 17, comprising:
allowing flow in a second direction opposite said first direction to enter said wash pipe around said seat and exit said wash pipe through a return port and into said annular space;
providing a check valve in said return port;
removing gravel from said annular space with flow passing through said check valve.

19. The method of claim 15, comprising:
providing a clearance in the bore of the packer as it is set;
allowing a fluid column to act through said clearance during setting of the packer to exert pressure on the formation below the packer for resisting cave-ins into the wellbore.

20. The method of claim 19, comprising:
selectively blocking said clearance in said packer when following fluid in a first direction to deposit gravel in said annular region.

* * * * *